US008748761B2

(12) United States Patent
Mrazek et al.

(10) Patent No.: US 8,748,761 B2
(45) Date of Patent: Jun. 10, 2014

(54) SEALED ELECTRIC SWITCH AND METHOD FOR ASSEMBLY

(75) Inventors: Zdenek Mrazek, Barcelona (ES); Dolors Fuentes, Creteil Cedex (FR); Victor Villagrasa, Creteil Cedex (FR)

(73) Assignee: Valeo Securite Habitacle, Creteil (FR)

( * ) Notice: Subject to any disclaimer, the term of this patent is extended or adjusted under 35 U.S.C. 154(b) by 230 days.

(21) Appl. No.: 13/375,619

(22) PCT Filed: Jun. 4, 2010

(86) PCT No.: PCT/EP2010/057831

§ 371 (c)(1), (2), (4) Date: Apr. 13, 2012

(87) PCT Pub. No.: WO2010/139786

PCT Pub. Date: Dec. 9, 2010

(65) Prior Publication Data

US 2012/0186954 A1 Jul. 26, 2012

(30) Foreign Application Priority Data

Jun. 5, 2009 (EP) ..... 09380115

(51) Int. Cl.
*H01H 3/16* (2006.01)

(52) U.S. Cl.
USPC ..... 200/61.44

(58) Field of Classification Search
USPC ..... 200/61.44, 302.1, 302.2

IPC ..... H01H 13/06,13/183
See application file for complete search history.

(56) References Cited

U.S. PATENT DOCUMENTS

| | | | | |
|---|---|---|---|---|
| 4,803,320 | A | 2/1989 | Lupoli et al. | |
| 4,839,483 | A * | 6/1989 | Doyle | 200/302.1 |
| 5,008,505 | A * | 4/1991 | Takano et al. | 200/531 |
| 6,744,345 | B2 | 6/2004 | Korczynski et al. | |

FOREIGN PATENT DOCUMENTS

EP 0 552 591 A2 7/1993

OTHER PUBLICATIONS

International Search Report w/translation from PCT/EP2010/057831 dated Oct. 1, 2010 (4 pages).

* cited by examiner

*Primary Examiner* — Vanessa Girardi
(74) *Attorney, Agent, or Firm* — Osha Liang LLP

(57) ABSTRACT

The invention relates to an electric switch for a rear door or tailgate of an automobile, including: an electric subassembly (6) comprising a microswitch (7), and a mechanical subassembly (8) comprising a means for activating said microswitch (7), characterised in that said electric (6) and mechanical (8) subassemblies comprise an assembly means which engages to attach said subassemblies (6, 8) to one another and said electric switch (1) also comprises a seal (15) moulded over a joining area between said mechanical (8) and electric (6) subassemblies. The invention also relates to a method for manufacturing an electric switch for a rear door or tailgate of an automobile such as previously described.

12 Claims, 8 Drawing Sheets

Figure 1:
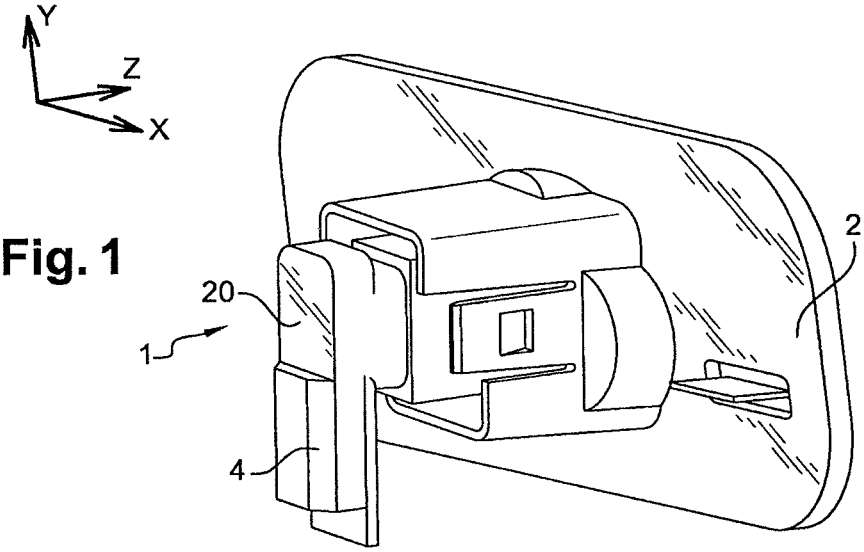

Fig. 3a
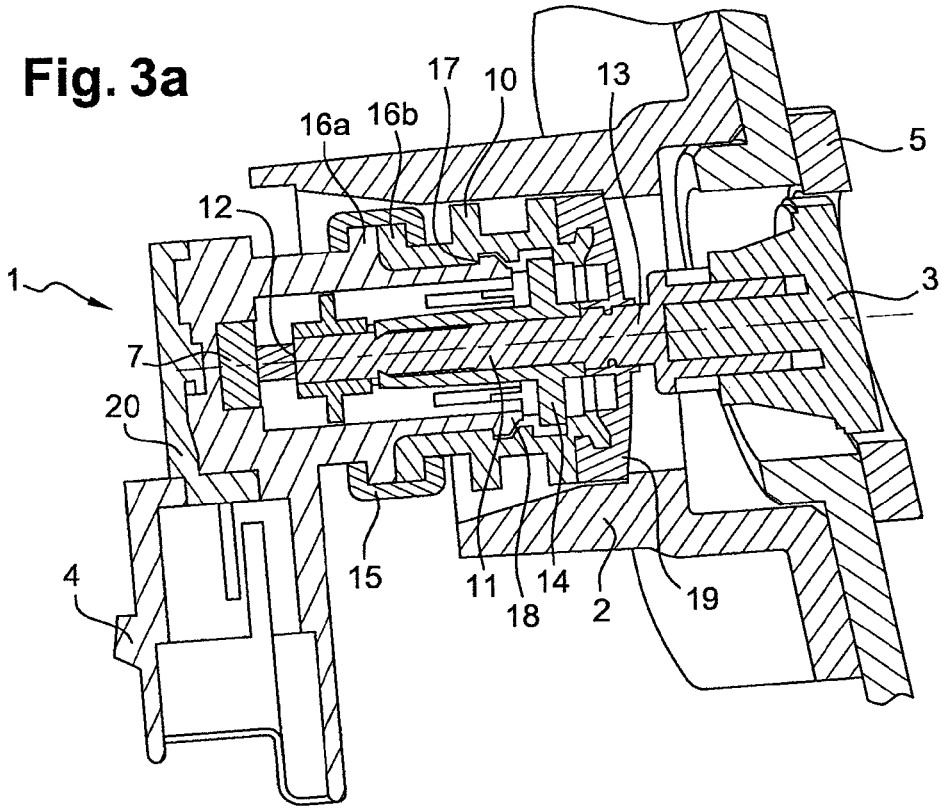
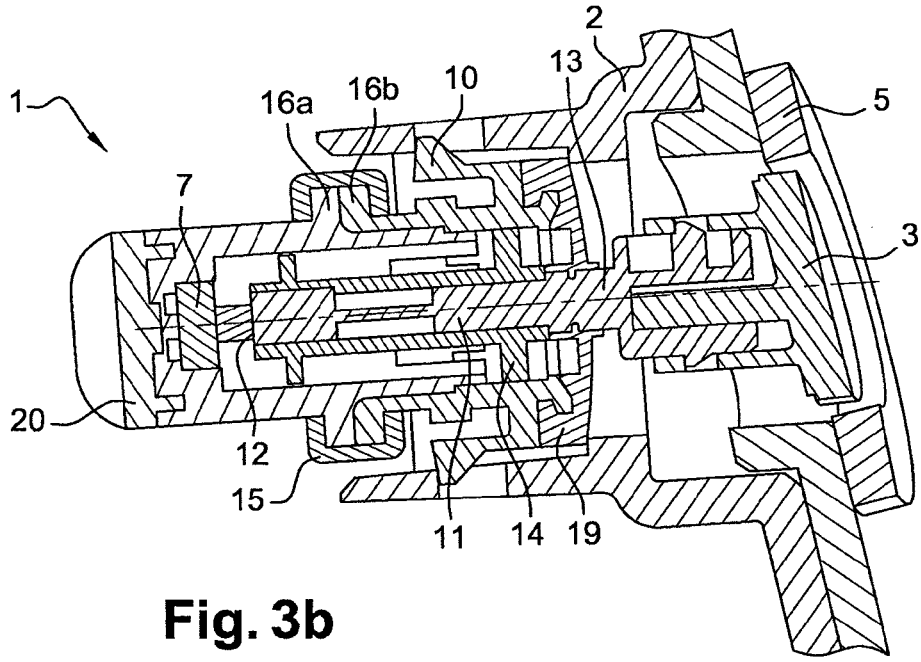
Fig. 3b

SEALED ELECTRIC SWITCH AND METHOD FOR ASSEMBLY

The present invention relates to an electric switch for an opening of an automobile, such as a side door, a rear trunk lid or rear tailgate.

The electric switch provokes the opening of the door, after having released the lock through the corresponding closure; manually or activated with the vehicle opening remote control or hands-free vehicle owner recognition system.

Electric switches for opening automobile openings are known that comprise a module, sealed by a membrane and provided with means for mounting on the frame of a side door or rear door of a vehicle. Inside the module there is a lever for, actuating a microswitch positioned under the membrane. This lever can be displaced between two positions, a rest position in which it is separated from said microswitch, and a switching position in which it is in contact with said microswitch when the user presses on the membrane. The lever returns to its initial rest position when the pressure ceases, the triggering of said microswitch resulting in the opening of the lock.

The microswitch is connected to metallic terminals. A sealing cover can be molded over the assembly formed by the microswitch and the terminals soldered to it. The cover overmolding process is completed during a high-pressure overinjection step.

However, a large percentage of switches have to be rejected during manufacture because of the high pressure of the injection process. The flow of injected polymer fractures the connection of the tabs of the microswitch with the terminals. Furthermore, the microswitch may be broken during the process.

To obtain a correct overinjection, parameters such as the pressure, the temperature and the dosage therefore have to be finely controlled to avoid damaging the switch.

Furthermore, a large percentage of switches are rejected during manufacture because of the poor position of the assembly formed by the microswitch and the terminals soldered to it at the moment of closure of the mold during the overmolding process. Consequently, the switches lose their water-tightness and their operating integrity.

Furthermore, the seal is not always sufficiently guaranteed at other points of the switch, thus providing ingresses for moisture from outside the vehicle that can damage the electric circuits.

The present invention therefore aims to at least partially resolve the problems of the prior art by proposing a robust electric switch, having a better seal-tightness and an enhanced method for manufacturing said switch.

To this end, the subject of the invention is an electric switch for a door or rear tailgate of an automobile, comprising:

- an electric subassembly comprising a microswitch, and
- a mechanical subassembly comprising means for activating said microswitch, said activation means being able to be displaced between two positions, a first rest position and a second active position, characterized in that said electric and mechanical subassemblies include cooperating assembly means for fixing said subassemblies together and in that said electric switch also includes a seal molded over a joining area between said mechanical and electric subassemblies.

The overmolded peripheral seal mounted astride the two electric and mechanical subassemblies makes it possible to easily obtain an entirely sealed switch. In other words, this overmolding of the seal attaches and entirely seals two subassemblies respectively containing mechanical and electric elements. The electric switch is thus made seal-tight to water or moisture from outside the vehicle or from outside the trim of the switch. This robust arrangement allows for the overmolding of the joining area of the two subassemblies without prejudicing the elements contained in the subassemblies with a good level of seal-tightness.

According to one or more characteristics of the electric switch, taken alone or in combination,

- said seal is in the form of a frame,
- the overmolded seal comprises a thermoplastic material, such as an elastomer TPE-S,
- said mechanical subassembly and said electric subassembly are assembled in the joining area by shape cooperation,
- the mechanical subassembly and the electric subassembly have protruding planar peripheral edges cooperating to be assembled in the joining area,
- the mechanical subassembly and the electric subassembly have protruding peripheral edges respectively having a recess in which a metallic reinforcing member is received,
- the assembly means also include fixing means housed inside said electric switch,
- the fixing means are produced by snap-fitting,
- said activation means comprise an actuation lever for said microswitch and an elastic return means for returning said actuation lever to the rest position,
- the elastic return means comprises an over molded spring having a first end molded over said actuation lever and a second end positioned around said microswitch,
- said activation means comprise an overmolded flexible membrane positioned around said actuation lever,
- the electric subassembly includes a cover partially overmolding the connectors of said microswitch.

Also the subject of the invention is a method for manufacturing an electric switch for a rear door or tailgate of an automobile as described previously, characterized in that said electric and mechanical subassemblies are assembled before placing them in a mold to form said seal molded over said joining area between said mechanical and electric subassemblies.

It is also possible to overmold the cover and said elastic membrane during the overmolding of said seal.

Figure 2:
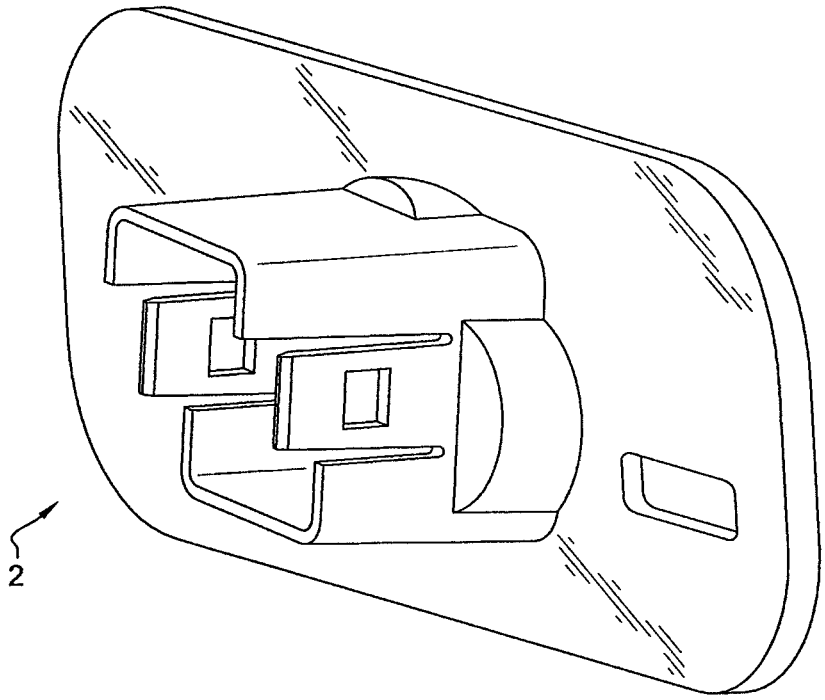
Figure 4:
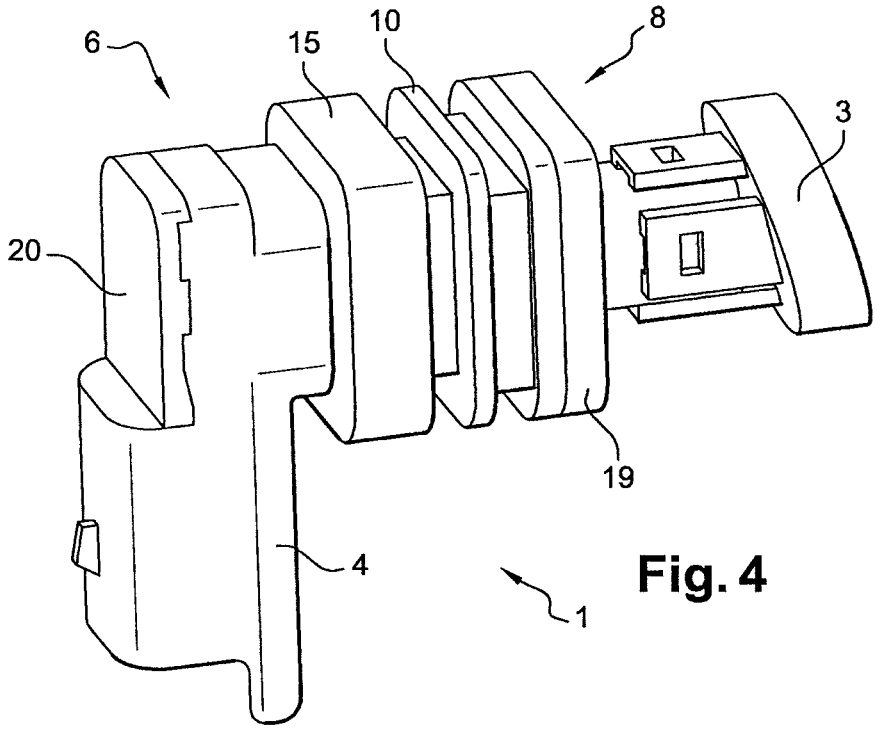
Figure 5:
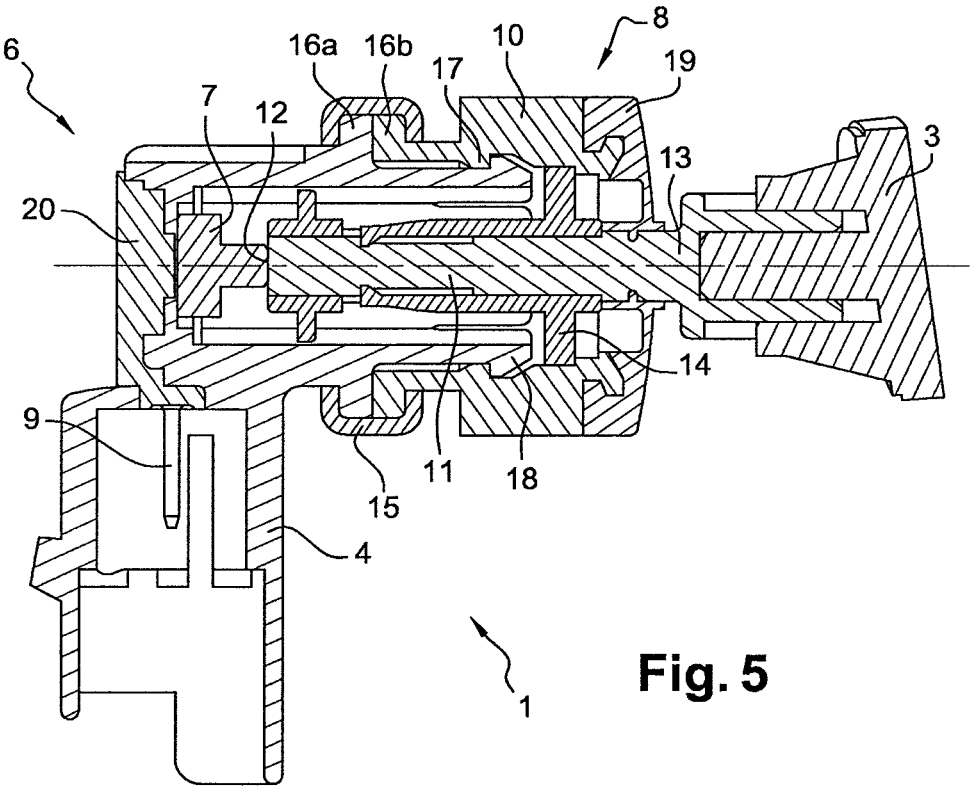
Figure 6:
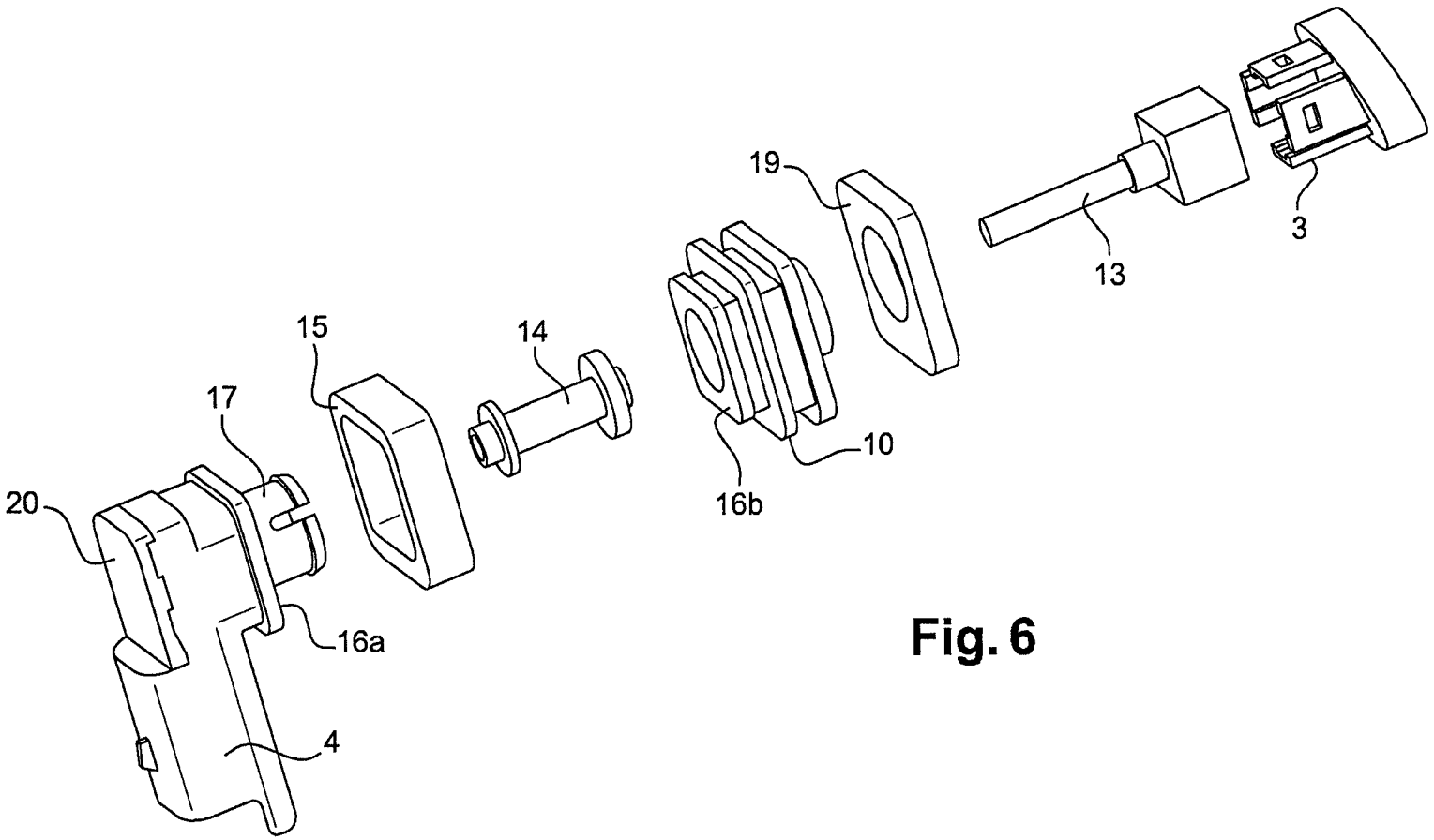
Figure 7:
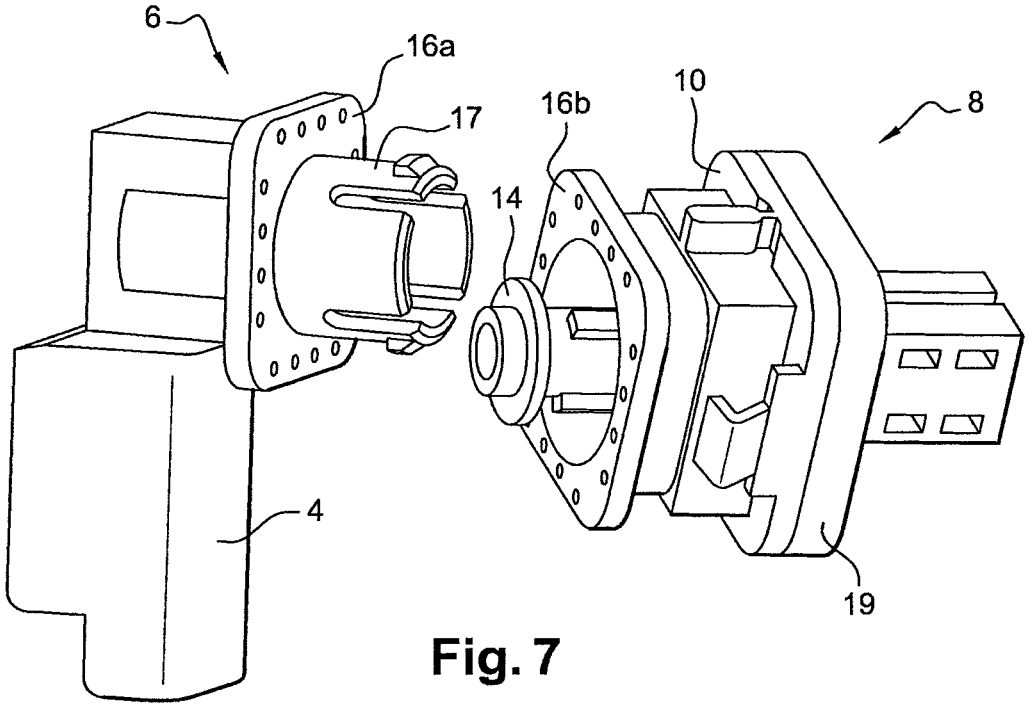
Figure 8:
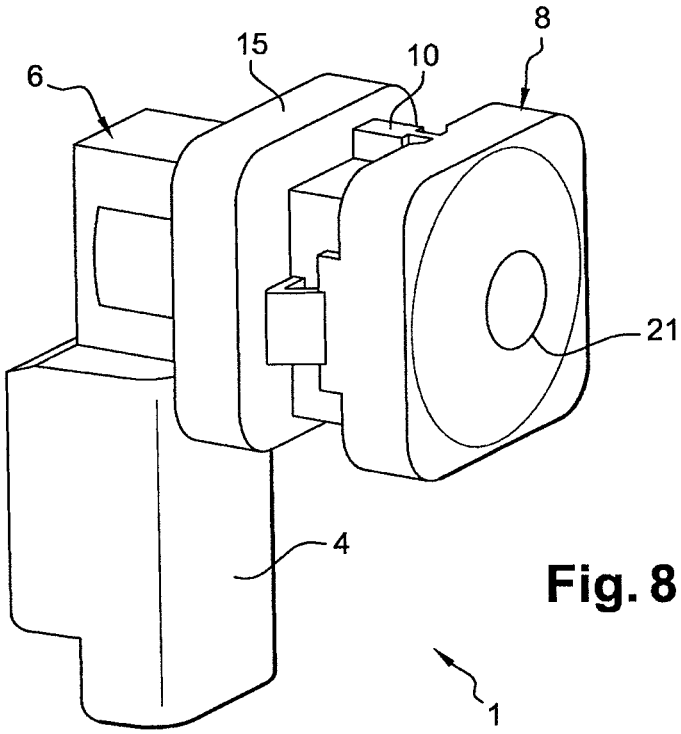
Figure 9A:
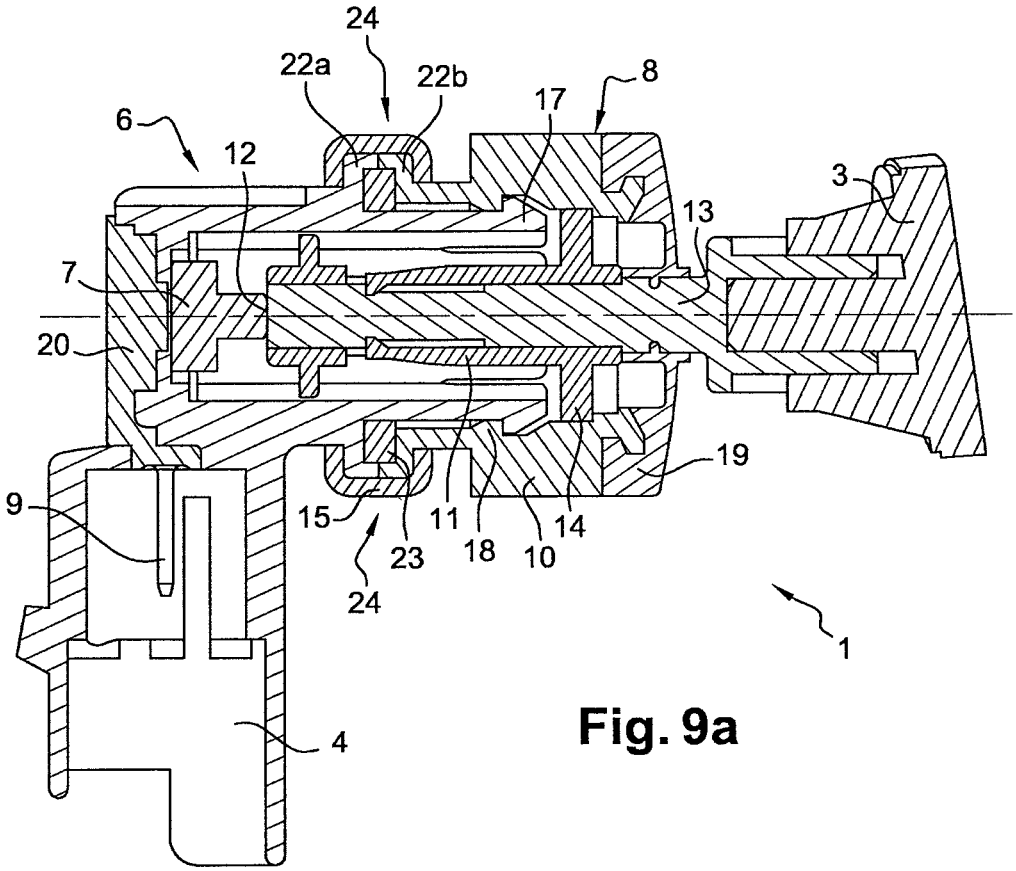
Figure 9B:
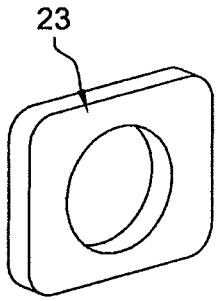
Figure 10:
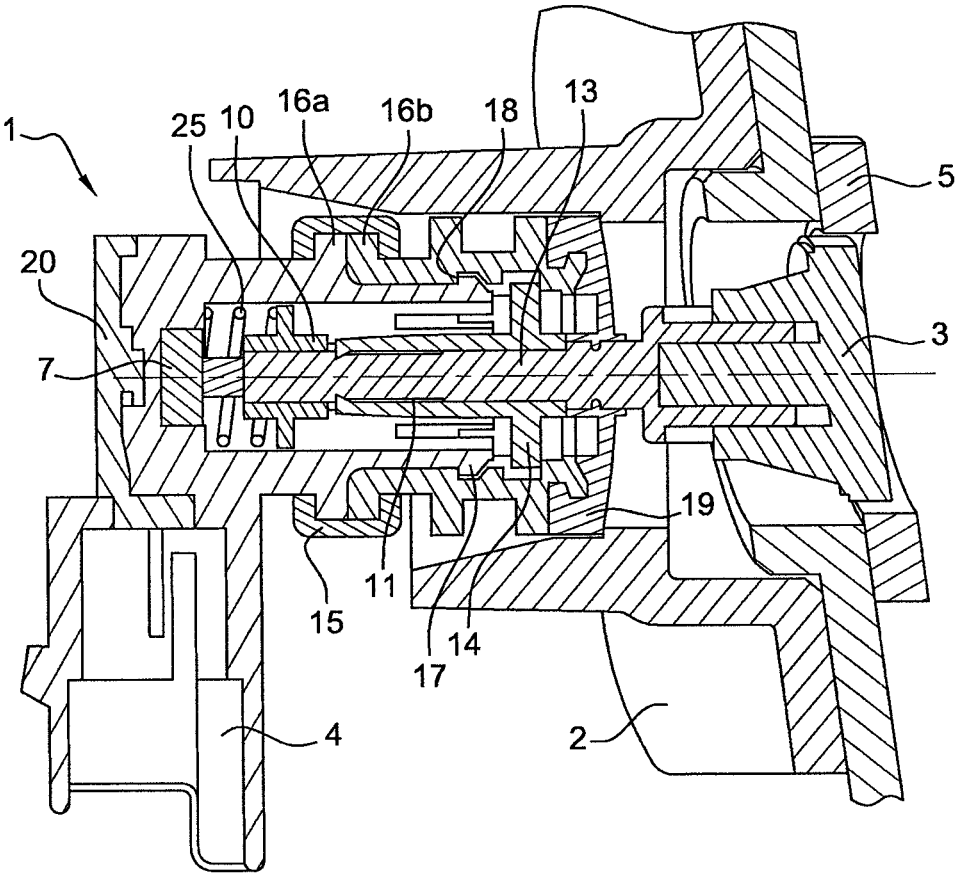
Figure 11A:
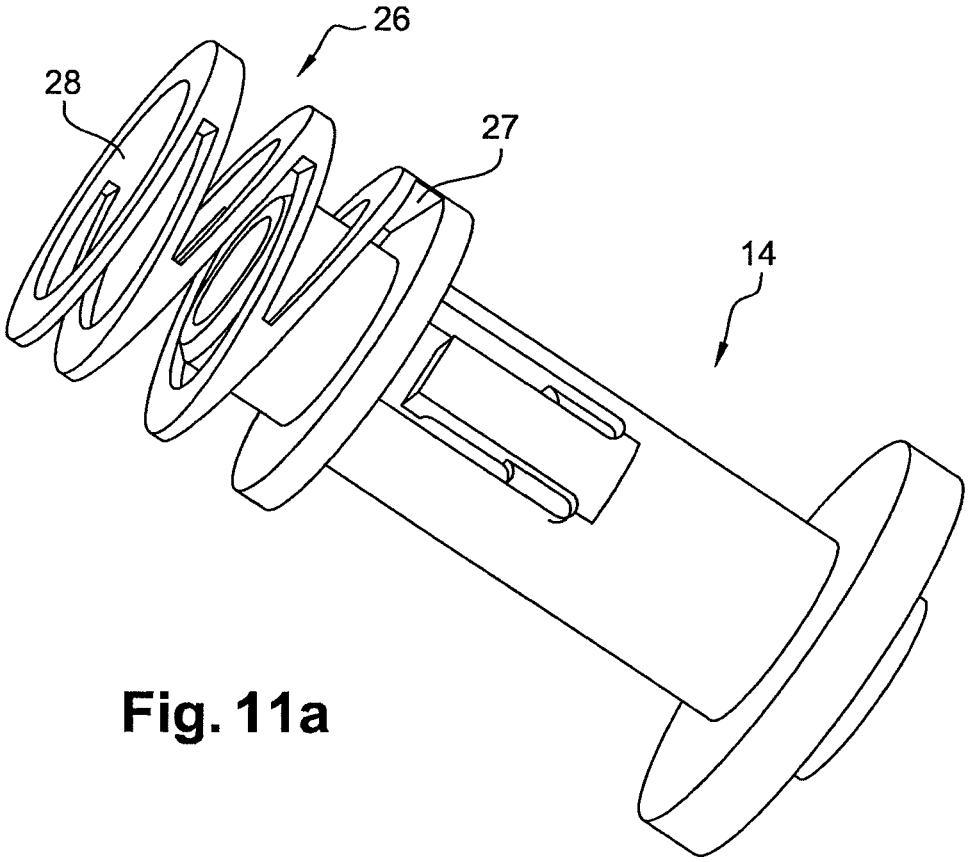
Figure 11B:
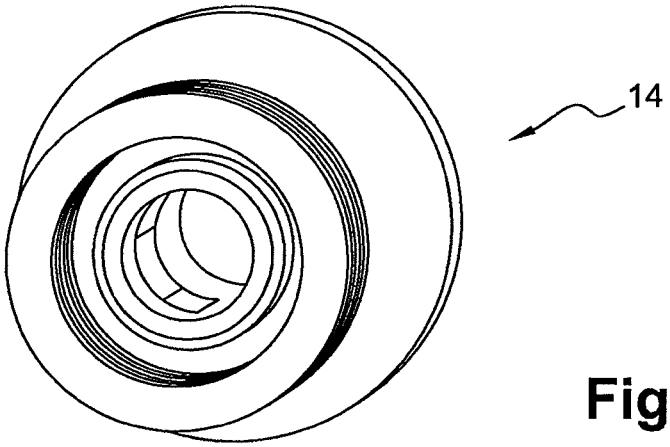

Other advantages and features will become apparent from reading the description of the invention, and the following figures in which:

FIG. 1 represents an electric switch according to a first embodiment, mounted in a support of a rear door or tailgate of an automobile, seen from inside the passenger compartment of an automobile, FIG. 2 is a perspective view of the support of FIG. 1, FIG. 3*a* is a cross-sectional view in the plane (Y, Z) of the electric switch of FIG. 1 mounted in said support, FIG. 3*b* is a cross-sectional view in the plane (X, Z) of the electric switch of FIG. 1 mounted in said support, FIG. 4 is a perspective view of the electric switch of FIG. 1, FIG. 5 is a longitudinal cross-sectional view of the electric switch of FIG. 4, FIG. 6 is a perspective view of the electric switch of FIG. 4 in the disassembled state, FIG. 7 is a perspective view of the electric subassembly and of a part of the mechanical subassembly of the switch of FIG. 4, FIG. 8 is a perspective view of an electric switch according to a second embodiment, FIG. 9*a* is a longitudinal cross-sectional view of an electric switch according to a third embodiment, FIG. 9*b* is a perspective view of a reinforcing member of the electric switch of FIG. 9*a*, FIG. 10 is a longitudinal cross-sectional view of an electric switch according to a fourth embodiment, mounted in said support, FIG. 11*a* is a side perspective view of a guiding and holding case including an overmolded spring of an electric switch according to a fifth embodiment, and FIG. 11*b* is a front perspective view of the guiding case of FIG. 11*a*.

In all the figures, the identical elements are given the same reference numbers.

FIGS. 1, 2, 3*a* and 3*b* represent an electric switch 1 mounted on a support 2 of an automobile opening, such as a side door, a trunk lid or rear tailgate, seen from inside the passenger compartment.

The support 2 can be arranged above the fender in the case of a rear trunk lid electric switch, for example in a top portion of an extension of the plastic part of the fender.

The support 2 includes a through recess in which the electric switch 1 is fixed, for example by snap-fitting, such that a control button 3 of the electric switch 1 is accessible to a user from outside the vehicle and that a connector 4 of the electric switch 1 can be linked to the electric circuits arranged inside the vehicle. The control button 3 is, for example, positioned such that it is flush with the fender of the automobile at the level of the brand name of the automobile. Provision can also be made for the electric switch 1 to have a trim 5 on the outside of the opening, encircling the accessible part of the control button 3.

The electric switch 1 provokes the opening of the door, after having released the lock through the corresponding closure; manually or remotely activated with the vehicle opening remote control or hands-free vehicle owner recognition system.

A first embodiment of the electric switch 1 is shown in FIGS. 1 to 7.

The electric switch 1 has an electric subassembly 6 comprising a microswitch 7 and a mechanical subassembly 8 comprising activation means for said microswitch 7 (FIG. 7).

The electric subassembly 6 comprises a casing having a tubular axial recess for the insertion of said activation means, said recess ending with the electric connector 4 inside which are housed the electric terminals of the microswitch (FIG. 5). The electric terminals have, for example, connection pins 9 at their ends. The connection pins 9 then provide the male connector function suitable for coupling to an appropriate female connector.

The mechanical subassembly 8 includes a sheath 10 having, for example, a substantially tubular central opening in which are mounted the activation means for said microswitch.

The activation means comprise, for example, the control button 3 and an actuation lever 11 for said microswitch 7 fixed to said control button 3. The actuation lever 11 is, for example, fixed by snap-fitting to said control button 3. To this end, the control button 3 includes, for example, a central section opposite to a tactile actuation surface, that is inserted into a corresponding recess of said actuation lever 11 and side elastic fixing tabs each having an orifice coupling with a corresponding protuberance borne by the corresponding end of said actuation lever 11 (see, for example, FIGS. 3*a* and 3*b*).

The actuation lever 11 is positioned axially to the microswitch 7 and it can be displaced between two positions, a rest position, in which it is separate from said microswitch 7, and a switching position (see FIG. 5), in which its end 12 is in contact with said microswitch 7 when the user presses on the tactile actuation surface of the control button 3, provoking the opening of the lock.

Provision is made for the actuation lever 11 to include an actuation axis 13 housed in a guiding and holding case 14 for the actuation lever 11.

The guiding case 14 has, for example, an internal tubular through-recess for receiving the actuation axis 13 and has an outer surface cooperating with the tubular opening of the sheath 10 and an inner recess of the electric subassembly 6, to maintain and guide the actuation axis 11 in its actuation, particularly in case of excessive actuation forces on the part of the user.

The electric 6 and mechanical 8 subassemblies also include cooperating assembly means for fixing said subassemblies 6, 8 together and the electric switch 1 also includes a seal 15 molded over the joining area between said mechanical 8 and electric 6 subassemblies.

The mechanical subassembly 8 and the electric subassembly 6 are, on the one hand, assembled in the joining area by shape cooperation. The interstices between the two subassemblies 6, 8 are then reduced.

For example, and as represented in FIGS. 4 to 7, the sheath 10 of the mechanical subassembly 8 and the casing of the electric subassembly 6 have planar protruding peripheral edges 16*a*, 16*b*, cooperating when they are mounted facing one another to be assembled in the joining area. It can thus be distinguished in FIG. 7 that the peripheral edges 16*a*, 16*b* have a generally square shape. The peripheral edge 16*a* of the casing also has a plurality of holes intended to cooperate with a plurality of corresponding protuberances provided in the peripheral edge 16*b* of the sheath 10, to facilitate their alignment.

Also, the assembly means include fixing means, for example housed inside said electric switch 1. The fixing means are then protected from the external environment of the switch 1.

The fixing means can be produced by snap-fitting. To this end, the sheath 10 includes, for example, an annular holding hook 17 in the tubular opening, cooperating with teeth of corresponding snap-fitting arms 18 borne by the casing of the electric subassembly 6.

At the moment of assembly, the mechanical subassembly 8 is then assembled with the electric subassembly 6 by inserting the actuation lever 11 inside the tubular axial recess of the casing of the electric subassembly 6. The snap-fitting arms 18 of the casing are attached to the corresponding annular hook 17 of the sheath 10, and the peripheral edges 16*a*, 16*b* of the casing and of the sheath 10 are joined in the joining area. The joining area is then overmolded.

The overmolded peripheral seal 15 mounted straddling the two electric 6 and mechanical 8 subassemblies makes it possible to easily obtain an entirely sealed electric switch 1. In other words, this overmolding of the seal 15 attaches and entirely seals two subassemblies respectively containing mechanical and electric elements. The electric switch 1 is thus made seal-tight to water or moisture from outside the vehicle or from outside the trim of the switch. This robust arrangement allows for the overmolding of the joining area of the two subassemblies 6, 8 without prejudicing the elements contained in the subassemblies 6, 8, with a good level of seal-tightness.

Provision is made, for example, for said seal 15 to be in the form of a generally square frame, topping the protruding peripheral edges 16*a*, 16*b*.

The plastic used for the overmolding is a "soft" plastic. It comprises, for example, a thermoplastic material, such as an elastomer TPE-S. The bodies of the electric 6 and mechanical 8 subassemblies, such as the casing, the sheath 10, the activation means, are molded from a "hard" plastic, for example polypropylene.

The elastomers offer the advantage of strongly adhering to the hard plastics, such as polypropylene, which consequently makes it possible to obtain a good seal. Furthermore, the pressures used for the injection machines are lower, which reduces the risks of deterioration of the switch during manufacture.

The activation means also include an elastic return means for returning said actuation lever 11 to the initial rest position when the pressure ceases.

The activation means also include an overmolded flexible membrane 19, positioned around the actuation lever 11 of the activation means. The flexible membrane 19 is molded over the sheath 10 of said mechanical subassembly 8. The plastic used for the overmolding is also a "soft" plastic, such as, for example, a thermoplastic material, such as an elastomer TPE-S. The flexible membrane 19 allows the axial movement of the actuation lever 11.

The electric subassembly 6 may also include a cover 20 partially overmolding the connectors of said microswitch 7. The cover 20 is thus positioned axially to the microswitch 7 and to the actuation lever 11, at the rear of said microswitch 7 from where the connectors leave. The plastic used for the overmolding is also a "soft" plastic, such as, for example, a thermoplastic material, such as an elastomer TPE-S.

When a user presses on the button, it provokes the displacement of the actuation lever 11, which in turn activates the microswitch 7 by closing the electric circuit, which makes it possible to open the door or the trunk lid of the vehicle. Once the user stops exerting the pressure, the elastic return means displace the control button 3 and the activation lever 11 to their initial positions.

A second embodiment of the electric switch 1 is represented in FIG. 8. The electric switch 1 has the same elements bearing the same references as in the first embodiment.

The difference lies in the fact that the activation means do not include any control button but a control membrane 21 overmolded at the end of the sheath 10 and at the end of the actuation lever 11. The control membrane 21 is intended to be received in the support 2 so as to be accessible to a user from outside the vehicle to activate the actuation lever 11.

A third embodiment of the electric switch 1 is represented in FIGS. 9*a* and 9*b*. The electric switch 1 has the same elements bearing the same references as in the first embodiment.

The difference lies in the fact that the mechanical subassembly 8 and the electric subassembly 6 have protruding peripheral edges 22*a*, 22*b* respectively having a recess in which a metallic reinforcing member 23 is received. The metallic reinforcing member 23 is, for example, made of steel. It has, for example, a circular central orifice and a substantially square-shaped outer peripheral contour (see FIG. 9*b*). It makes it possible to better withstand the lateral pressures (see arrows 24 in FIG. 9*a*) provoked by the injection at the time of overmolding.

A fourth and a fifth embodiment of the electric switch 1 are respectively represented in FIGS. 10, 11*a* and 11*b* and present exemplary embodiments of the elastic return means. The electric switch 1 has the same elements bearing the same references as in the first embodiment.

The elastic return means comprises a spring positioned between the microswitch 7 and the guiding case 14 of the actuation lever 11.

According to the fourth embodiment represented in FIG. 10, the spring 25 is metallic. For example, the spring 25 is made of steel.

According to the fifth embodiment represented in FIGS. 11*a* and 11*b*, the elastic return means comprises a molded plastic spring 26 having a first end 27 molded over said actuation lever 11. More specifically, the first end 27 is, for example, molded over the guiding case 14 of the actuation axis 13 of the actuation lever 11.

The second end 28 of the overmolded spring 26 has, for example, an annular form, that can be positioned around said microswitch 7.

This variant makes it possible to reduce the manufacturing costs.

The method for manufacturing the electric switch 1 comprises the following succession of steps.

The bodies of the electric and mechanical subassemblies are manufactured, for example from a hard plastic molding in a first mold.

Then, said electric and mechanical subassemblies are assembled, for example by snap-fitting, before placing them in another mold and the joining area is overmolded with a soft plastic to form said seal 15 molded over said joining area between said mechanical 8 and electric 6 subassemblies. It is also possible to overmold the cover 20 and said elastic membrane 19 from said same soft plastic in the same step on the assembly line, which reduces the manufacturing costs.

The overmolding is carried out using a conventional plastic injection machine with lower pressures than those recommended by the usage standards.

The electric switch 1 obtained in this way is therefore more robust and exhibits a very high degree of seal-tightness. Furthermore, the manufacturing method makes it possible to reduce the number of rejected parts and is less costly.

Generally, said mechanical subassembly comprises activation means that can be displaced between two positions, a first rest position and an active position.

According to the embodiment described previously, the rest position consists in said idle activation means being maintained at a distance from said microswitch and the active position is a switching position in which they are in contact with said microswitch.

According to another embodiment, the activation means may be in contact whether the microswitch is in the on or off state.

According to another alternative, the electric switch includes at least one intermediate element between the microswitch and the activation means, this intermediate element belonging to the electric subassembly and/or to the mechanical subassembly.

The invention claimed is:

1. An electric switch for a door or rear tailgate of an automobile, comprising:

an electric subassembly comprising a microswitch; and a mechanical subassembly comprising means for activating said microswitch, wherein said electric and mechanical subassemblies include assembly means cooperating for fixing said subassemblies, wherein said electric switch also includes a seal molded over a joining area between said mechanical and electric subassemblies, wherein said electric subassembly and said mechanical subassembly are assembled in the joining area by shape cooperation, and wherein said electric subassembly and said mechanical subassembly have protruding peripheral edges respectively having a recess in which a metallic reinforcing member is received.

2. The electric switch as claimed in claim 1, wherein said seal is in the form of a frame.

3. The electric switch as claimed in claim 1, wherein the overmolded seal comprises an elastomer TPE-S thermoplastic material.

4. The electric switch as claimed in claim 1, wherein the mechanical subassembly and the electric subassembly have protruding planar peripheral edges cooperating for assembly in the joining area.

5. The electric switch as claimed in claim 1, wherein the electric subassembly includes a cover partially overmolding connectors of said microswitch.

6. The electric switch as claimed in claim 1, wherein the assembly means also include fixing means housed inside said electric switch.

7. The electric switch as claimed in claim 6, wherein the fixing means are produced by snap-fitting.

8. The electric switch as claimed in claim 1, wherein said activation means comprise an actuation lever for said microswitch and an elastic return means for returning said actuation lever to a rest position.

9. The electric switch as claimed in claim 8, wherein the elastic return means comprises an overmolded spring having a first end molded over said actuation lever and a second end positioned around said microswitch.

10. The electric switch as claimed in claim 8, wherein said activation means comprise an overmolded flexible membrane positioned around said actuation lever.

11. An electric switch for a door or rear tailgate of an automobile, comprising:

an electric subassembly comprising a microswitch; and a mechanical subassembly comprising means for activating said microswitch, wherein said electric and mechanical subassemblies include assembly means cooperating for fixing said subassemblies, wherein said electric switch also includes a seal molded over a joining area between said mechanical and electric subassemblies, wherein said activation means comprise an actuation lever for said microswitch and an elastic return means for returning said actuation lever to a rest position, and wherein the elastic return means comprises an overmolded spring having a first end molded over said actuation lever and a second end positioned around said microswitch.

12. The electric switch as claimed in claim 11, wherein the electric subassembly includes a cover partially overmolding connectors of said microswitch.

* * * * *